US009925577B2

(12) United States Patent
Ilinich et al.

(10) Patent No.: US 9,925,577 B2
(45) Date of Patent: Mar. 27, 2018

(54) ROTARY-DRAW BENDING MANDREL WITH GALLING-RESISTIVE INSERTS

(71) Applicant: Ford Global Technologies, LLC, Dearborn, MI (US)

(72) Inventors: Andrey M. Ilinich, Dearborn, MI (US); S. George Luckey, Jr., Dearborn, MI (US); Stephen Kernosky, Livonia, MI (US); Feng Ren, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 92 days.

(21) Appl. No.: 14/279,808

(22) Filed: May 16, 2014

(65) Prior Publication Data

US 2015/0328671 A1 Nov. 19, 2015

(51) Int. Cl.
*B21D 9/03* (2006.01)

(52) U.S. Cl.
CPC ..... *B21D 9/03* (2013.01)

(58) Field of Classification Search
CPC .... B21D 9/01; B21D 9/03; B21D 9/04; B29C 53/82
USPC ..... 72/149–150, 152, 154–155, 369, 370.01, 72/466.2, 466; 425/393
See application file for complete search history.

(56) References Cited

U.S. PATENT DOCUMENTS

| | | | | |
|---|---|---|---|---|
| 2,962,077 A | | 11/1960 | Condiff et al. | |
| 3,456,482 A | | 7/1969 | Maier et al. | |
| 5,588,505 A | * | 12/1996 | Heath | B21D 9/03 184/18 |
| 6,085,572 A | * | 7/2000 | McGuire, Sr. | B21D 9/03 72/466.2 |
| 6,389,872 B1 | * | 5/2002 | Hanson | B21D 11/00 72/398 |

OTHER PUBLICATIONS

A. Gillard, et al.; "Incremental Forming of 5xxx and 6xxx Aluminum Alloys for Improved Formability"; Ford Research and Advanced Engineering Technical Reports, SRR-2005-0096, Project No. AJ41G, Jun. 6, 2005; 48 pages.

H.K. Yi, et al.; "Application of a combined heating system for the warm hydroforming of lightweight alloy tubes"; Elsevier, Journal of Materials Processing Technology, vol. 203, (2008), pp. 532-536.

* cited by examiner

*Primary Examiner* — Peter DungBa Vo
*Assistant Examiner* — Joshua D Anderson
(74) *Attorney, Agent, or Firm* — LeClairRyan

(57) ABSTRACT

A galling-resistive insert is positioned on an outer surface of a mandrel assembly. The insert is secured at the outer surface of the mandrel assembly and functions to reduce galling of an inner surface of a tubular blank during a rotary-draw bending operation.

8 Claims, 5 Drawing Sheets

ROTARY-DRAW BENDING MANDREL WITH GALLING-RESISTIVE INSERTS

BACKGROUND

Mandrels and mandrel balls help prevent tube buckling, wrinkling, and collapse in a rotary-draw bending operation. During bending, high normal forces between the mandrel and an inner surface of the tube create frictional forces at the contact interface. The relative motion between the outer surfaces of the mandrel and inner surface of the tube (workpiece) often creates galling on the inner surface of the tube. The presence of galling creates the need for cleaning (down-time, loss of productivity, etc.) and often leads to failure of the workpiece.

SUMMARY

An embodiment of the present invention is directed to a galling-resistive insert for use in a mandrel assembly. The insert is secured at the outer surface of portions of the mandrel assembly and functions to reduce galling of an inner surface of a tubular blank.

In one embodiment, the present invention includes a mandrel-ball assembly that is comprised of a ball body, an insert, and a securing mechanism. The ball body includes an indentation in an outer surface within which an insert is at least partially positioned. The securing mechanism retains the insert in the indentation.

Another embodiment of the present invention includes a mandrel-shank assembly that is comprised of a shank body, an insert, and a securing mechanism. The shank body includes an indentation in an outer surface within which an insert is at least partially positioned. The securing mechanism retains the insert in the indentation.

An additional embodiment of the present invention includes a method for bending a tubular blank. According to the method, a tubular blank is clamped and a mandrel-ball assembly is positioned within a hollow central region of the tubular blank. The mandrel-ball assembly includes a ball body with an indentation in an outer surface, an insert at least partially positioned within the indentation, and a securing mechanism that retains the insert in the indentation. The tubular blank is then bent.

Embodiments of the invention are defined by the claims below, not this summary. A high-level overview of various aspects of the invention is provided here to provide an overview of the disclosure and to introduce a selection of concepts further described below in the detailed-description section. This summary is not intended to identify key or essential features of the claimed subject matter, nor is it intended to be used as an aid in isolation to determine the scope of the claimed subject matter.

BRIEF DESCRIPTION OF THE DRAWINGS

Illustrative embodiments of the present invention are described in detail below with reference to the attached figures, which are incorporated herein by reference, wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies.

As stated elsewhere in the specification, the present invention is directed to a galling-resistive insert for use in a mandrel assembly. The insert is secured at the outer surface of portions of the mandrel assembly and functions to reduce galling of an inner surface of a tubular blank.

Figure 1B:
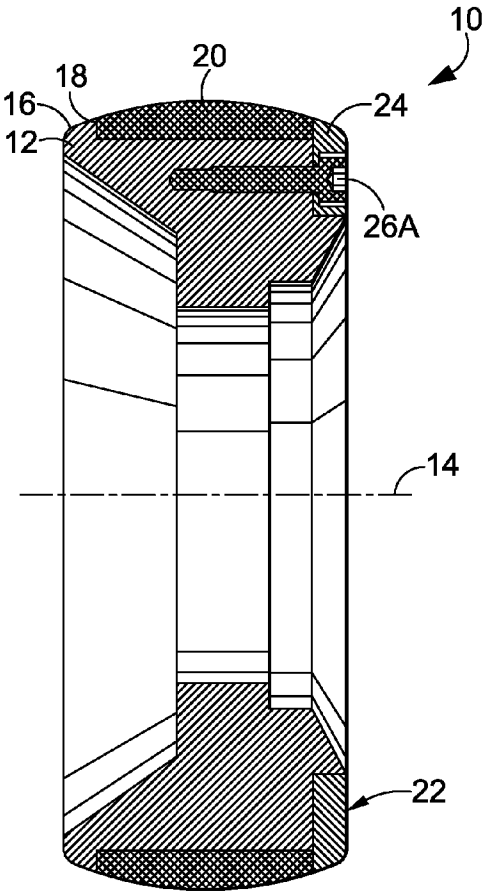
FIG. 1B is a cross-sectional view of the exemplary mandrel-ball assembly of FIG. 1A taken in the direction of arrows 1B-1B.
Figure 1A:
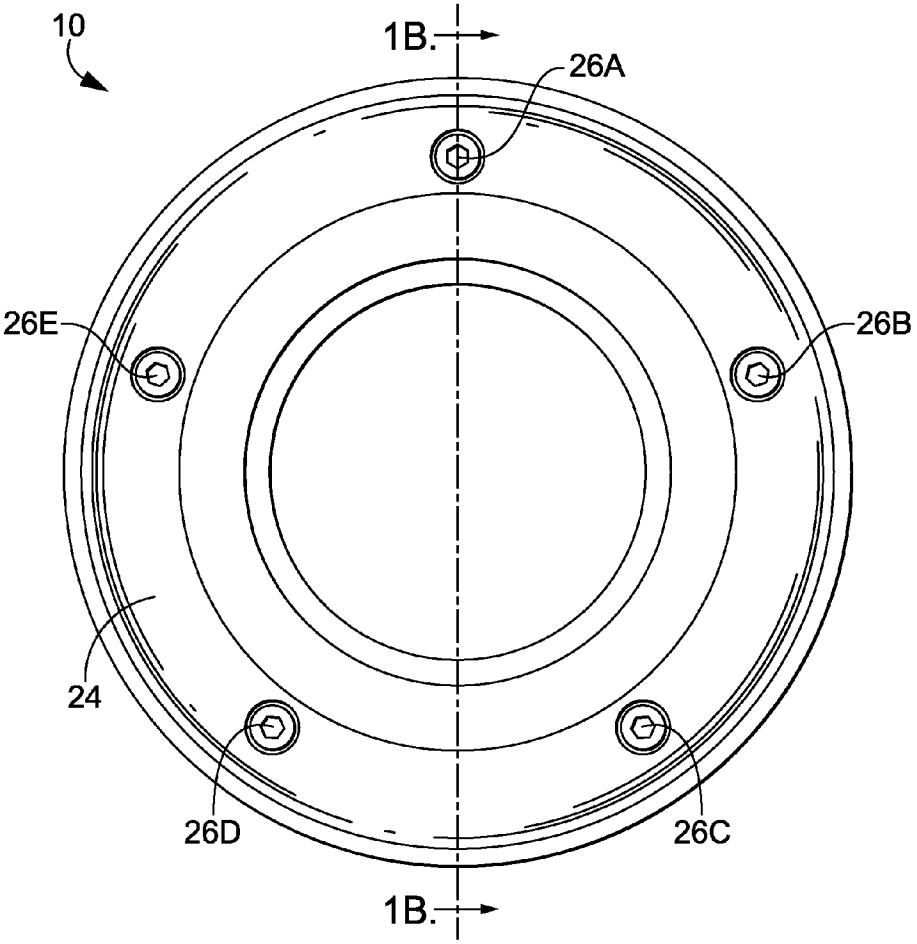
FIG. 1A is a plan view of an end of an exemplary mandrel-ball assembly in accordance with an embodiment of the present invention.

Referring now to FIG. 1A, a portion of a mandrel-ball assembly 10 is illustrated in an end-perspective view. FIG. 1B depicts a cross-sectional view taken in the direction of arrows 1B-1B. Generally, the mandrel-ball assembly 10 includes a ball body 12 and a galling-resistive insert 20, which is retained in place by a securing mechanism 22.

The illustrated embodiment includes the ball body 12 that is generally symmetric about centerline axis 14. Outer surface 16 of ball body 12 includes indentation 18 and insert 20 is at least partially positioned within indentation 18.

Figure 2:
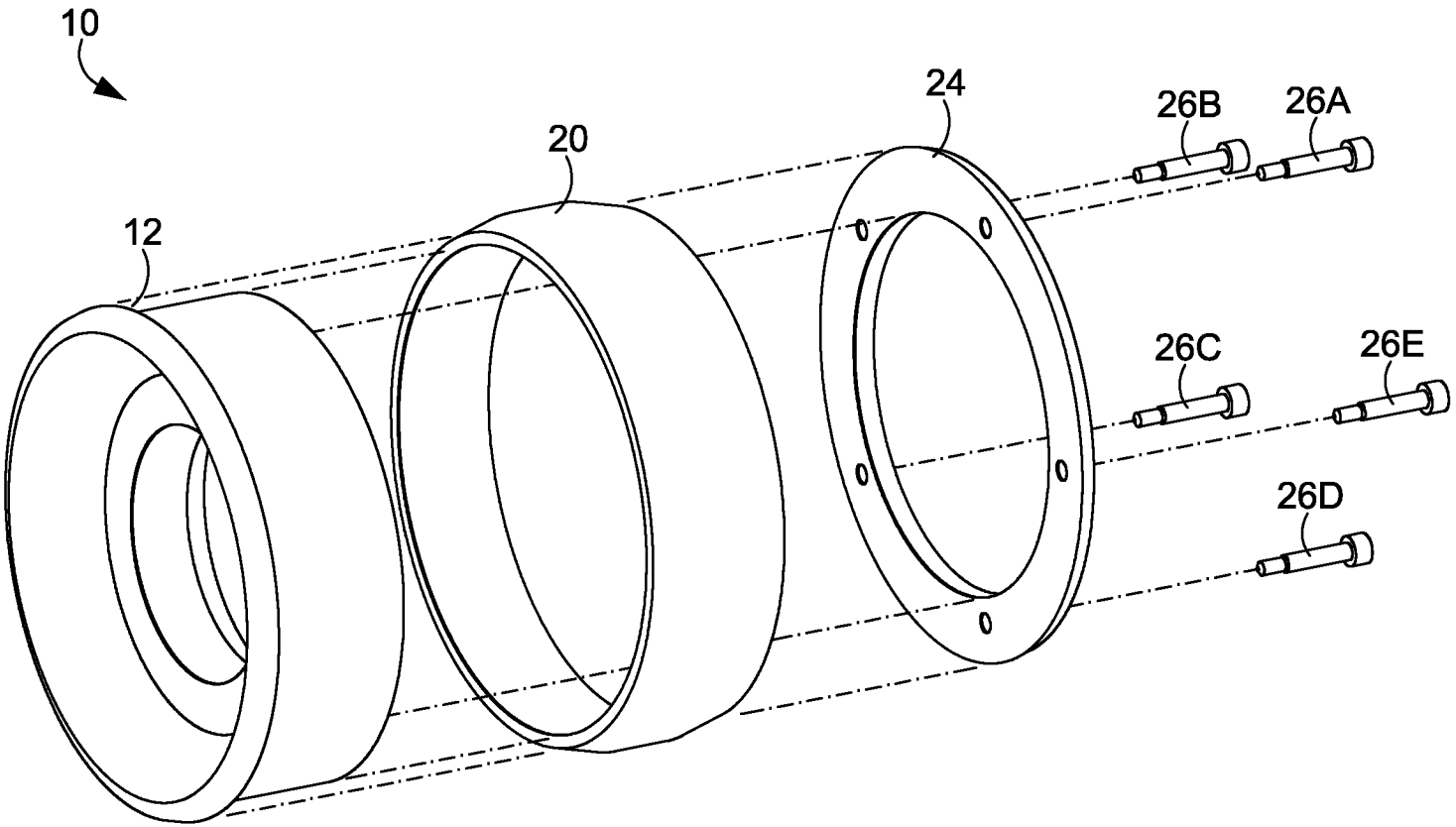
FIG. 2 is an exploded view of an exemplary mandrel-ball assembly in accordance with an embodiment of the present invention.

In the figures, the insert 20 comprises a ring of material that is generally symmetric about centerline axis 14 and extends 360° about the outer surface 16 of ball body 12. Securing mechanism 22 is placed adjacent to insert 20 and retains insert 20 within indentation 18. In the embodiment shown, securing mechanism 22 includes holding ring 24 that captures insert 20 within indentation 18. Securing mechanism 22 also includes a plurality of separate fasteners 26A-E that secure holding ring 24 to ball body 12. Separate fasteners 26A-E may be threaded or unthreaded or may be of any type known by one skilled in the art. FIG. 2 depicts an exploded view of the mandrel-ball assembly of FIG. 1A and FIG. 1B, including ball body 12, insert 20, holding ring 24, and separate fasteners 26A-E.

Other securing mechanisms might also be used to retain the insert 20 in position. For instance, holding ring 24 may be secured to ball body 12 by mating together a threaded surface (male or female) on holding ring 24 with a complementary threaded surface (female or male, respectively) on ball body 12. That is, both the ball body 12 and the securing mechanism 22 might both be threaded and screwed together. In addition, holding ring 24 may be integrally formed with insert 20 creating a separate subassembly that is then secured to ball body 12 using any of the methods described. Other securing mechanisms, such as welding, adhesion, an interference fit, or a transition fit may also be used for embodiments that fall within the scope of the disclosed invention.

Insert 20 is positioned on the portion or portions of mandrel-ball assembly 10 that experience relatively high normal contact forces with an inner surface of a tubular blank during a bending operation. In one embodiment, insert 20 includes a single contiguous piece of material that at least partially circumscribes the outer surface 16. In an alternative embodiment, the insert 20 includes a discrete number of non-contiguous pieces of material that are shaped as incomplete arcs or triangles and that are spaced apart and around the outer surface 16. Insert 20 may include a uniform or non-uniform cross-sectional shape.

Insert 20 includes a galling-resistive material, which may include a plastic material, a low-stacking-fault-energy metal or metallic alloy (e.g., a copper-, bronze-, or cobalt-based alloy), a material that is metallurgically-incompatible with the tubular blank (i.e., insoluble solids), a low-friction material, and any combination thereof. Suitable plastic material includes, but is not limited to, nylon, polytetrafluoroethylene, polyoxymethylene, polyurethane, and polyethylene, or any combination thereof. Generally, the hardness of the galling-resistive material should be less than the hardness of the tubular blank in which the mandrel-ball assembly will be used during bending.

The exemplary embodiment shown in FIG. 1A represents a mandrel-ball assembly that may be used in a rotary-draw bending operation to bend a tubular blank having a generally circular cross-sectional area. However, a mandrel-ball assembly for use in bending tubes with non-circular cross-sectional areas, such as rectangular, triangular, nonsymmetrically-shaped, etc., is also contemplated. As such, embodiments in which ball body 12 is generally symmetric about a different axis or in which ball body 12 exhibits no symmetry are included within the scope of the claimed invention. Additionally, ball body 12 may be comprised of multiple parts connected together to form outer surface 16.

Figure 3A:
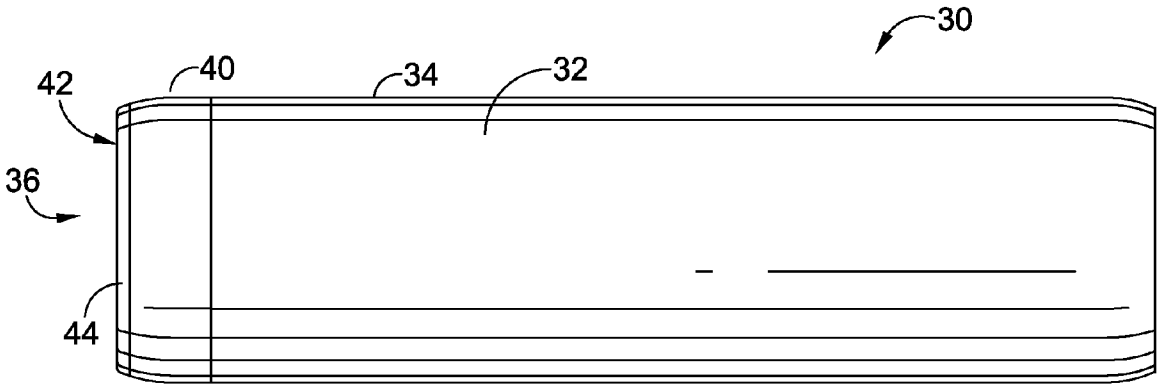
FIG. 3A is an exemplary mandrel-shank assembly in accordance with an embodiment of the present invention.
Figure 3B:
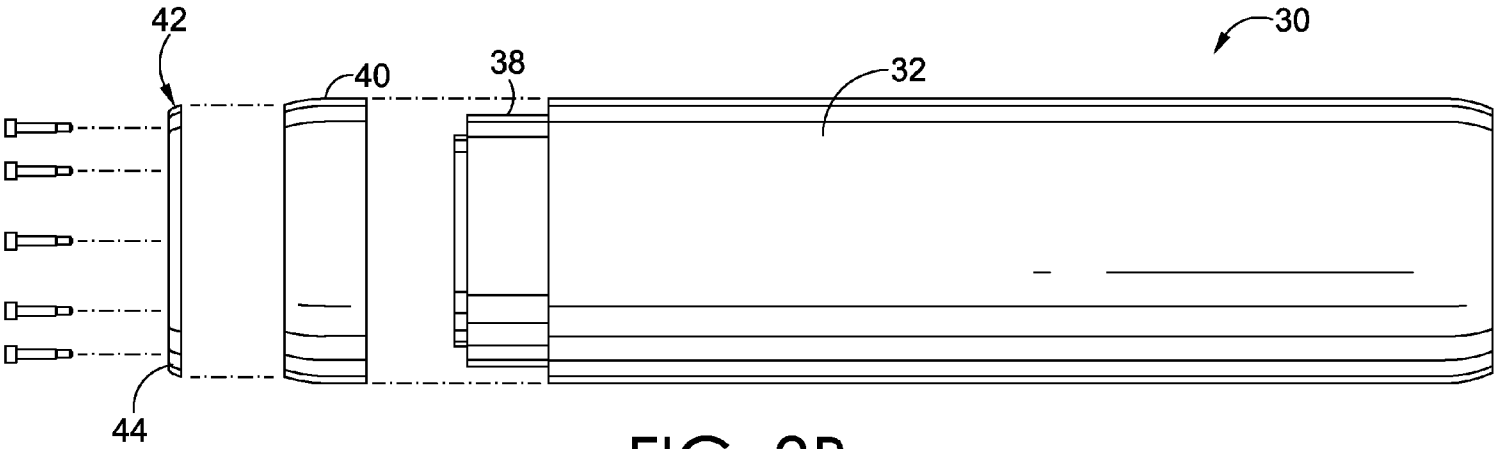
FIG. 3B is an exploded view of the exemplary mandrel-shank assembly shown in FIG. 3A.

Referring now to FIG. 3A and FIG. 3B, a side-perspective view of a mandrel-shank assembly 30 is depicted. The illustrated embodiment includes generally cylindrical shank body 32 that includes a circular cross-sectional area and an outer surface 34 defined by a length. Nose 36 of shank body 32 is the leading end of the mandrel-shank assembly when inserted into a tubular blank for bending.

Generally, nose 36 experiences relatively high normal contact forces with an inner surface of a tubular blank during a bending operation. Similar to the mandrel-ball assembly described above, outer surface 34 of shank body 32 includes indentation 38. Insert 40 is at least partially positioned within indentation 38. Insert 40 comprises a ring of material that extends about the outer surface 34 of shank body 32. Securing mechanism 42 is placed adjacent to insert 40 and retains insert 40 within indentation 38. Securing mechanism 42 includes holding ring 44 that captures insert 40 within indentation 38.

As similarly described above for securing mechanism 22, securing mechanism 42 may retain insert 40 in indentation 38 by threading holding ring 44 onto shank body 32 using complementary male/female threaded surfaces or may include a plurality of separate fasteners that secure holding ring 44 to shank body 32. Separate fasteners may be threaded or unthreaded or may be of any type known by one skilled in the art. Additionally, holding ring 44 may also be integrally formed with insert 40 creating a separate subassembly that is then secured to shank body 32 using any of the methods described herein.

Other securing mechanisms, such as welding, adhesion, an interference fit, or a transition fit may also be used for embodiments that fall within the scope of the disclosed invention. Furthermore, the disclosed invention is not limited to the exemplary embodiment shown in FIG. 3A and FIG. 3B. Embodiments in which shank body 32 includes a cross-sectional area that is rectangular, triangular, or some other shape are included within the scope of the claimed invention. Additionally, shank body 32 may be comprised of multiple parts connected together to form outer surface 34.

Insert 40 is positioned on a portion of nose 36 of shank body 32. Similar to insert 20 described above, insert 40 includes a galling-resistive material, which may include a plastic material (e.g., nylon, polytetrafluoroethylene, polyoxymethylene, polyurethane, polyethylene, etc.), a low-stacking-fault-energy metal or metallic alloy (e.g., a copper-, bronze-, or cobalt-based alloy), a material that is metallurgically-incompatible with the tubular blank (i.e., insoluble solids), a low-friction material, and any combination thereof. Generally, the hardness of the galling-resistive material should be less than the hardness of the tubular blank in which the mandrel-ball assembly will be used during bending. In addition, insert 40 may include a single contiguous piece of material or may be formed of a discrete number of non-contiguous pieces of material and may include a uniform or non-uniform cross-sectional shape.

Figure 4:
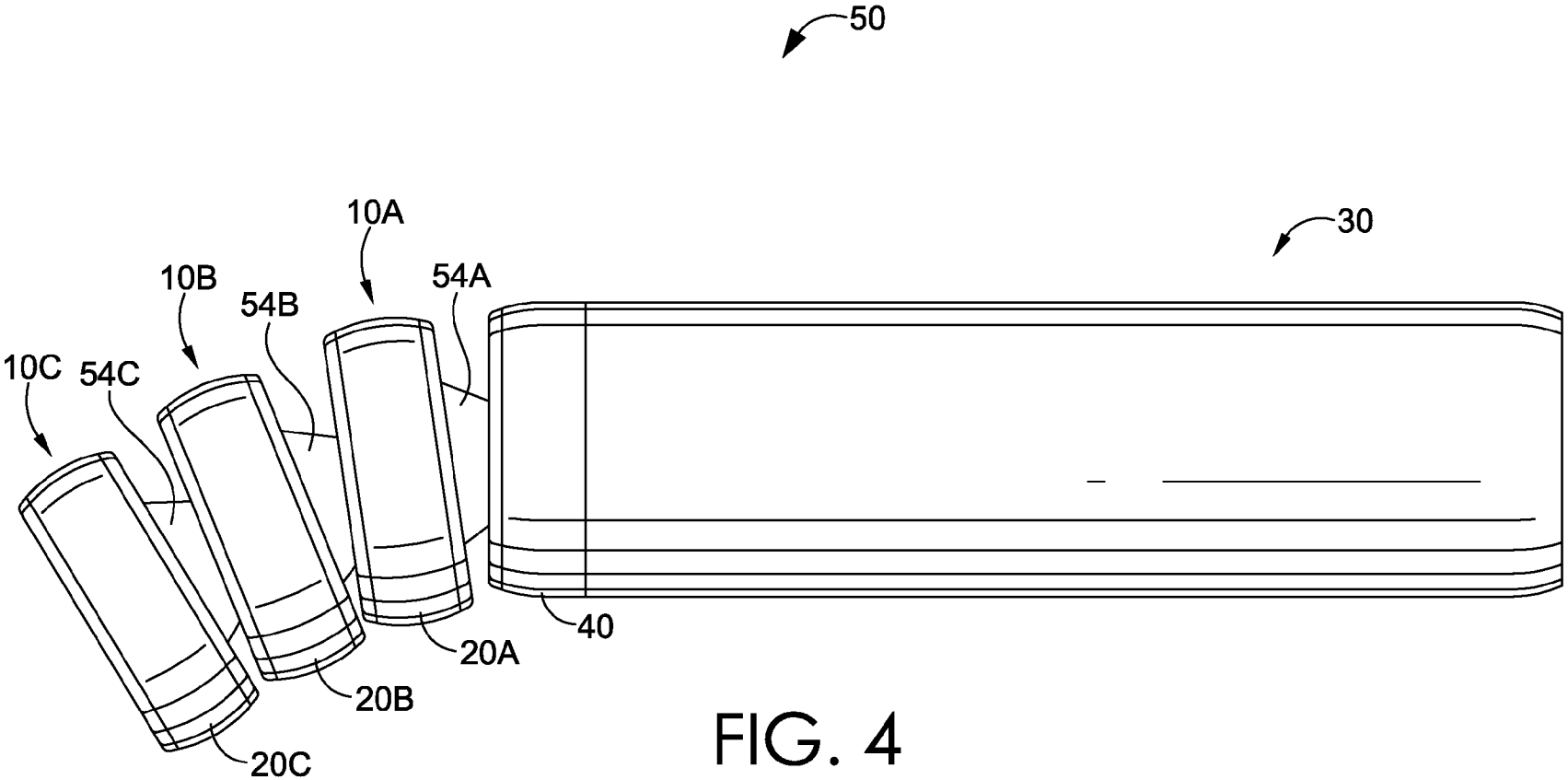
FIG. 4 is an exemplary mandrel assembly comprising a mandrel-shank assembly and a plurality of connected mandrel-ball assemblies in accordance with an embodiment of the present invention.

Referring now to FIG. 4, an exemplary mandrel assembly 50 comprising a mandrel-shank assembly 30 and a plurality of connected mandrel-ball assemblies 10A-C in accordance with an embodiment of the present invention is depicted. At least one mandrel-ball assembly 10A is connected to the nose 36 of mandrel-shank assembly 30 by way of an articulating link 54A. Additional mandrel-ball assemblies (e.g., 10B and 10C) may be connected to mandrel-ball assembly 10A in series by way of additional articulating links (e.g., 54B and 54C.) Articulating links 54A-C may be of any form known by a person skilled in the art (e.g., a spherical joint, an H-type link, poppit link, end link, etc.). Alternatively, mandrel-ball assemblies 10A-C may be connected to mandrel-shank assembly 30 by way of a cable onto which the mandrel-ball assemblies 10A-C are strung.

Insert 40 and inserts 20A-C may include the same galling-resistant material or the same combination of materials in accordance with embodiments described herein. Alternatively, insert 40 and one or more of insert 20A, 20B, and 20C may each include a different galling-resistant material or combination of materials in accordance with embodiments described herein. Although the embodiment shown in FIG. 4 depicts mandrel assembly 50 comprised of a mandrel-shank assembly 30 in accordance with the embodiment shown in FIGS. 3A and 3B and a plurality of mandrel-ball assemblies 10 in accordance with the embodiment shown in FIGS. 1-2, the disclosed invention is not limited to this exemplary embodiment. Embodiments include any combination of a mandrel-shank assembly with or without an insert 40 (optionally) connected to at least one mandrel-ball assembly with or without an insert 20, as long as either the mandrel-shank assembly or at least one of the connected mandrel-ball assemblies includes an insert as described herein.

Figure 5:
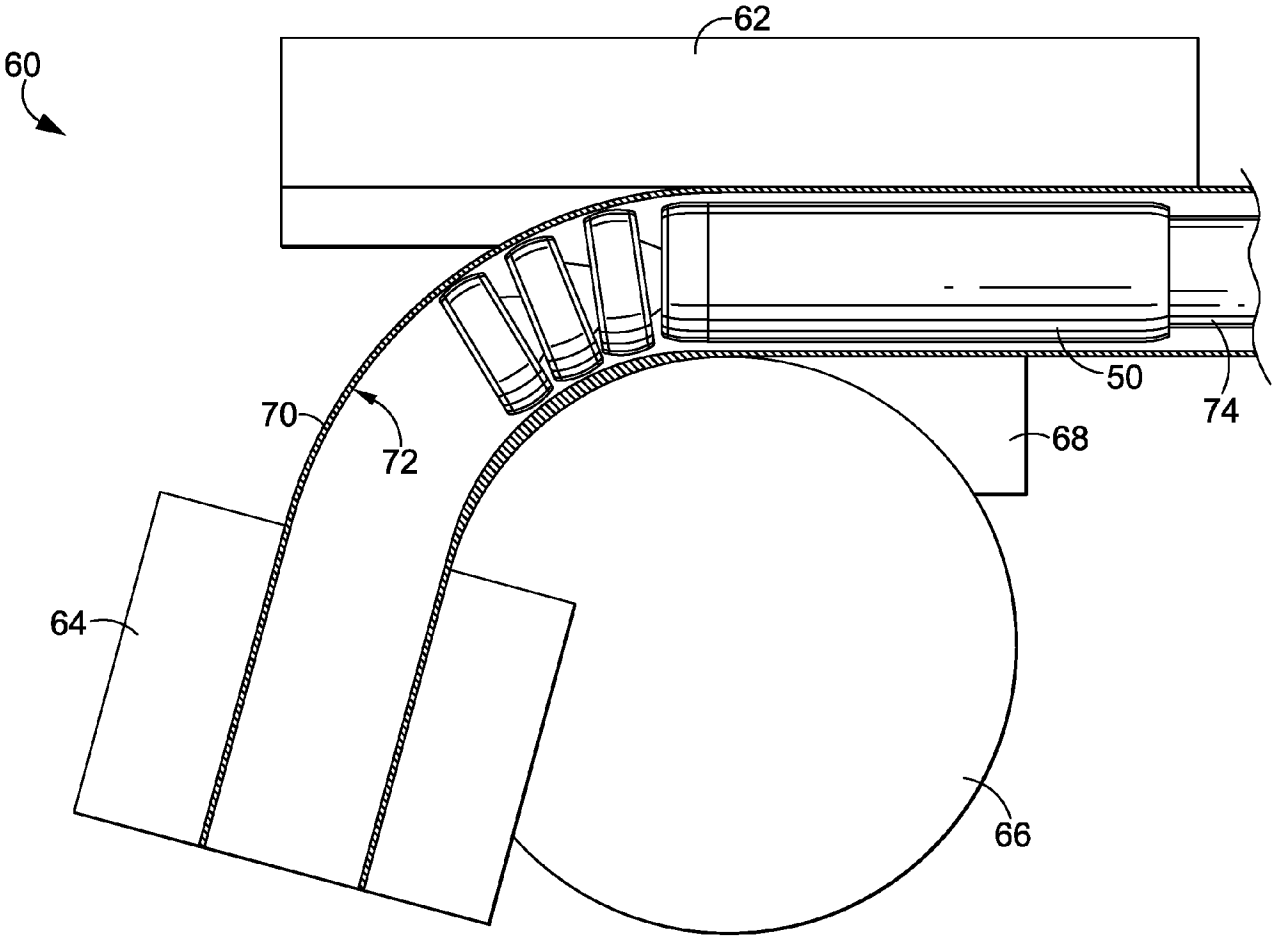
FIG. 5 is a plan view of an exemplary rotary-draw bending mechanism having a follower, clamp, bending die, wiper, and mandrel assembly.

Referring now to FIG. 5, a plan view of an exemplary rotary-draw bending mechanism 60 having a follower 62, clamp 64, bending die 66, wiper 68, and mandrel assembly 50 connected to rod 74 is illustrated. The leading edge of tubular blank 70 is clamped (using clamp 64) to bending die 66. Mandrel assembly 50 is placed within tubular blank 70. An outer surface 16 of ball body 12 and an outer surface 34 of shank body 32 are generally shaped to fit within tubular blank 70 such that outer surface 16 and outer surface 34 contact an inner surface 72 of tubular blank 70 during the bending process while allowing for mandrel assembly 50 to be easily inserted into tubular blank 70 (i.e., a small clearance fit). Bending die 66 rotates, drawing the tubular blank 70 around bending die 66. Inner surface 72 is supported by mandrel assembly 50 as tubular blank 70 is drawn around bending die 66. Tubular blank 70 is externally supported by follower 62 and wiper 68. The disclosed invention is not limited to the exemplary embodiment shown in FIG. 5. Mandrel assembly 50 helps prevent tube buckling, wrinkling, and collapse of tubular blank 70 during the bending operation. Other arrangements of components used in a rotary-draw bending operation, including components that are not shown, are possible without deviating from the scope of the disclosed invention.

For each of the exemplary embodiments discussed, many different alternative arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A mandrel-ball assembly comprising:

a ball body including an outer surface arranged between a front surface and a back surface of said ball body, said outer surface of said ball body having an insert-receiving indentation formed therein, said insert-receiving indentation defining a recessed wall and an end wall, said end wall interconnecting said outer surface of said ball body and said recessed wall of said insert-receiving indentation, said end wall of said insert-receiving indentation being adjacent to said front surface of said ball body said back surface of said ball body having a securing mechanism-receiving indentation formed therein;

an insert at least partially positioned within the insert-receiving indentation, said insert having a front wall and a back wall, said front wall of said insert abutting against said end wall of said insert-receiving indentation; and a securing mechanism for insertion into said securing mechanism-receiving indentation, the securing mechanism retaining the insert in the insert-receiving indentation by abutting against said back wall of said insert and said back surface of said ball body, the securing mechanism coaxially surrounding said securing mechanism-receiving indentation, thereby completely circumscribing said ball body, said insert being captured between said ball body and said securing mechanism.

2. The mandrel-ball assembly of claim 1, wherein the insert comprises a galling-resistant material.

3. The mandrel-ball assembly of claim 1, wherein the insert comprises a plastic material.

4. The mandrel-ball assembly of claim 3, wherein the plastic material includes nylon, polytetrafluoroethylene, polyoxymethylene, polyeurethane, polyethylene, or a combination thereof.

5. The mandrel-ball assembly of claim 1, wherein the insert includes a ring.

6. The mandrel-ball assembly of claim 1, wherein the securing mechanism includes a holding ring.

7. The mandrel-ball assembly of claim 1, wherein the securing mechanism includes at least one separate threaded fastener.

8. The mandrel-ball assembly of claim 1, wherein a portion of said ball body, an outer side of said insert, and a portion of the securing mechanism form a continuous arc.

* * * * *